United States Patent [19]

Kissell et al.

[11] Patent Number: 4,460,430

[45] Date of Patent: Jul. 17, 1984

[54] APPARATUS FOR SPLICING TAPES

[75] Inventors: John J. Kissell, Dunwoody; Joseph C. Sun, Lawrenceville, both of Ga.

[73] Assignee: AT&T Technologies, Inc., New York, N.Y.

[21] Appl. No.: 414,228

[22] Filed: Sep. 2, 1982

Related U.S. Application Data

[62] Division of Ser. No. 25,767, Apr. 24, 1981, abandoned.

[51] Int. Cl.[3] ..... B31F 5/06; B65H 69/06

[52] U.S. Cl. ..... 156/504; 156/505; 156/510; 242/56 R; 242/58.4; 242/58.5

[58] Field of Search ..... 156/502, 504, 505, 506, 156/510, 157, 159, 304.3; 242/56 R, 58.1, 58.4, 58.5; 83/477.2, 487, 505

[56] References Cited

U.S. PATENT DOCUMENTS

| | | | |
|---|---|---|---|
| 2,280,943 | 4/1942 | Ferm | 204/206 |
| 2,606,136 | 8/1952 | Garrett et al. | 156/505 |
| 2,752,984 | 7/1956 | Casey | 242/58.4 |
| 2,883,893 | 4/1959 | Bloxham et al. | 228/3.1 |
| 3,024,157 | 3/1962 | Beerli | 242/58.1 |
| 3,414,208 | 12/1968 | Butler et al. | 242/58.1 |
| 3,554,842 | 1/1971 | Byrt | 156/505 |
| 3,698,613 | 10/1972 | Gordon et al. | 226/118 |
| 3,728,197 | 4/1973 | Harris et al. | 156/506 |
| 3,738,587 | 6/1973 | Cristiani | 242/58.1 |
| 3,891,158 | 6/1975 | Shearon et al. | 242/58.1 |

*Primary Examiner*—Michael G. Wityshyn
*Attorney, Agent, or Firm*—E. W. Somers

[57] ABSTRACT

In an accumulating and a splicing apparatus (30), a nearly exhausted tape (31) is advanced at a line speed along a path which extends between two groups (49, 51) of rollers. One of the groups of rollers is moved upwardly to a position above the other group of rollers and a length of the nearly exhausted tape is accumulated in a sinusoidal path just prior to splicing. The nearly exhausted tape is clamped at an input side of the accumulator after which a severing device (104) is moved transversely across that tape to form a trailing end portion. The severing device is allowed to be spring-returned to a position above the nearly exhausted tape and to one side thereof which permits joining facilities to carry a leading end of a tape (35) of a new supply downwardly to be spliced to the trailing end portion of the nearly exhausted tape. While in a raised position, the severing device is moved back across the path of the nearly exhausted tape and caused to be moved downwardly to engage a supporting surface in preparation for another cycle. Meanwhile, the elevated group of rollers is moved downwardly at a speed which is controlled to decrease and to be less than the line speed to cause the new tape to be accelerated substantially linearly to the line speed.

7 Claims, 12 Drawing Figures

APPARATUS FOR SPLICING TAPES

This is a division of application Ser. No. 257,673 filed Apr. 24, 1981, now abandoned.

TECHNICAL FIELD

This invention relates to apparatus for splicing tapes. More particularly, this invention relates to apparatus for accumulating a length of tape which is being used in a manufacturing operation such as, for example, cable sheathing and for connecting it to a leading end of a tape of another supply.

BACKGROUND OF THE INVENTION

In the manufacture of particular kinds of cables for use in the communications field, a tape is advanced through processing apparatus and is formed about an advancing cable core. The tape may be metallic and used to form a shield, which protects the core mechanically and electrically, or it may be plastic, which protects the core from a metallic shield. Subsequently, a plastic material is extruded about the tape to form a joint.

During such operations, which are often referred to as sheathing, it is advantageous to be able to feed the tape continuously and substantially at a constant line speed so that the tape can be formed and the jacket extruded without interruption. One restriction on the continuous manufacture of such cables is that a cable is usually many times as long as commercial lengths of tapes which are supplied in coils called pads. To provide a tape long enough to be applied around a complete length of a core to be sheathed, it becomes necessary to join successively the trailing ends of a plurality of pads of tape to the leading ends of other pads.

The splicing of the leading end of a tape from a new supply to a trailing end portion of a tape from a nearly exhausted supply generally has been accomplished with apparatus which is complicated and which is time-consuming to operate. This has resulted in relatively low line speeds in sheathing operations in order to accommodate a splicing operation each time one pad is nearly exhausted and a new supply pad is required. A situation thus arises when the feed of the tape is controlling which prevents taking advantage of the maximum output rates of commercially available extruders.

The splicing of the end portions is usually accomplished by accumulating a length of the presently used supply after which a portion of the presently used tape is clamped adjacent to an input side of an accumulator. An accumulator is an apparatus which is used to accumulate a length of an advancing tape, for example, for a relatively short period of time. There are two kinds of accumulators in general use. One is a continuous accumulator in which a splice is made at any time. A disadvantage of this kind of accumulator is that the spliced joint between the tapes experiences substantial impact because the tape of the new supply must have a velocity which is higher than the line speed in order to replenish the accumulator.

The other kind of accumulator is referred to as a demand accumulator through which a tape is advanced without being accumulated. Accumulation can be caused to occur at any time. This provides an opportunity during payout of the accumulated length of material for an operation such as splicing to be performed on a portion of the tape on the input side of the accumulator which may be held stationary during payout of the accumulated length. Following these steps, the end portions are joined together, the nearly exhausted supply is unclamped and the accumulated length is payed out with the tape of the new supply being joined thereto.

Accumulators are known in the art with one arrangement being shown in U.S. Pat. No. 2,280,943. In that patent, the accumulator includes a series of rolls having their axes stationary and parallel to one another in a horizontal plane and another series mounted on a travelling carriage which moves up and down. The tape passes around top and bottom rolls alternately to form a sinuous path. Facilities are operated to clamp the tape at the time a splicing operation is required. With one group of rollers on a carriage in an elevated position, the tape continues to be fed from the output side of the accumulator whereby the carriage is pulled down against the counterbalancing action of a counterweight and a friction brake. The brake acts as a drag for maintaining substantially the same tension on the tape while it is being fed out from the accumulator.

In the prior art, it appears that in continuous accumulators, the carriages are held at elevated positions by counterweights which provide for uncontrolled back tension on the tape as it is payed out. As a result, the release of the trailing end portion of the nearly exhausted tape results in a sudden jerking of the tape due to the action of the counterweight. This may be acceptable when splicing steel tape but not those made of plastic or aluminum.

As for splicing, U.S. Pat. No. 3,554,842 shows a rotatable splicing head which is moveable toward an anvil to cut adjacent tapes to form a butt joint and which is then moved to apply a piece of adhesive tape across the tapes. While splicing or welding is occurring such as in U.S. Pat. No. 2,883,893, the remainder of the tape may be advanced because of the excess provided by a loop in an accumulator. Splicing has also been accomplished manually or by apparatus which requires an undue amount of cycle time.

Notwithstanding the existence of a variety of carriage-type accumulators and of splicing apparatus in the prior art, there does not appear to be one which provides for controlled acceleration of the tape of the new supply. The prior art does not appear to address the problem of impact on the spliced joint which is particularly important when splicing tapes of particular materials used in cable sheathing operations. Of additional interest and what the prior art also appears to lack is the capability of splicing tapes, particularly those which are used in cable sheathing operations, in a relatively short period of time.

SUMMARY OF THE INVENTION

The hereinbefore described problem which appears not to have been addressed by the prior art is overcome by methods and apparatus of this invention. The apparatus includes an accumulator through which a nearly exhausted tape is advanced in a path between rollers of a first group and adjacent rollers of a second group. The second group of rollers is moved from a position below the first group and in a direction away from the first group to a position spaced above the first group to dispose said tape in a sinuous path.

A trailing end of the nearly exhausted tape is clamped adjacent to the input side of the accumulator. In response to the clamping of the nearly exhausted tape, the second group of rollers is returned toward the position adjacent to the first group. Just as the second group begins its return, apparatus is operated to sever the nearly exhausted tape which extends from the sinuous path to form a trailing end portion. Then a leading end portion of a tape of a new supply is joined to the just-formed trailing end of the tape extending from the sinuous path. The strip material extending from the sinuous path is released while the return of the second group of rollers is continued. The continued return of the second group toward the first is accomplished at an intended speed which decreases and which is less than the speed at which the nearly exhausted tape is being advanced. This causes tape of the new supply to be accelerated at a controlled rate to the velocity of the nearly exhausted tape subsequent to the splicing of the leading and trailing end portions. This invention prevents an impact loading of the spliced joint or too rapid an acceleration which could result in a loss of control of the advance of the tapes.

One feature of this invention resides in the rapidity with which a splice may be made. At about the time that the leading end portion of a tape of a new supply is moved downwardly to engage the trailing end portion of the nearly exhausted tape, a disc-like cutting blade is drawn transversely across the nearly exhausted tape beyond the splice location. The blade is mounted on an arm which is biased downwardly to hold the blade in engagement with the nearly exhausted tape. After the blade has crossed the nearly exhausted tape, the bias is removed and the arm is allowed to move upwardly to move the blade out of the paths of the tapes. This permits the connection of the leading end portion of the tape of the new supply to the nearly exhausted tape which extends from the sinuous path without waiting for the return stroke of the cutting blade.

BRIEF DESCRIPTION OF THE DRAWINGS

Other features of the present invention will be more readily understood from the following detailed description of specific embodiments thereof when read in conjuction with the accompanying drawings, in which.

and

Figure 5:
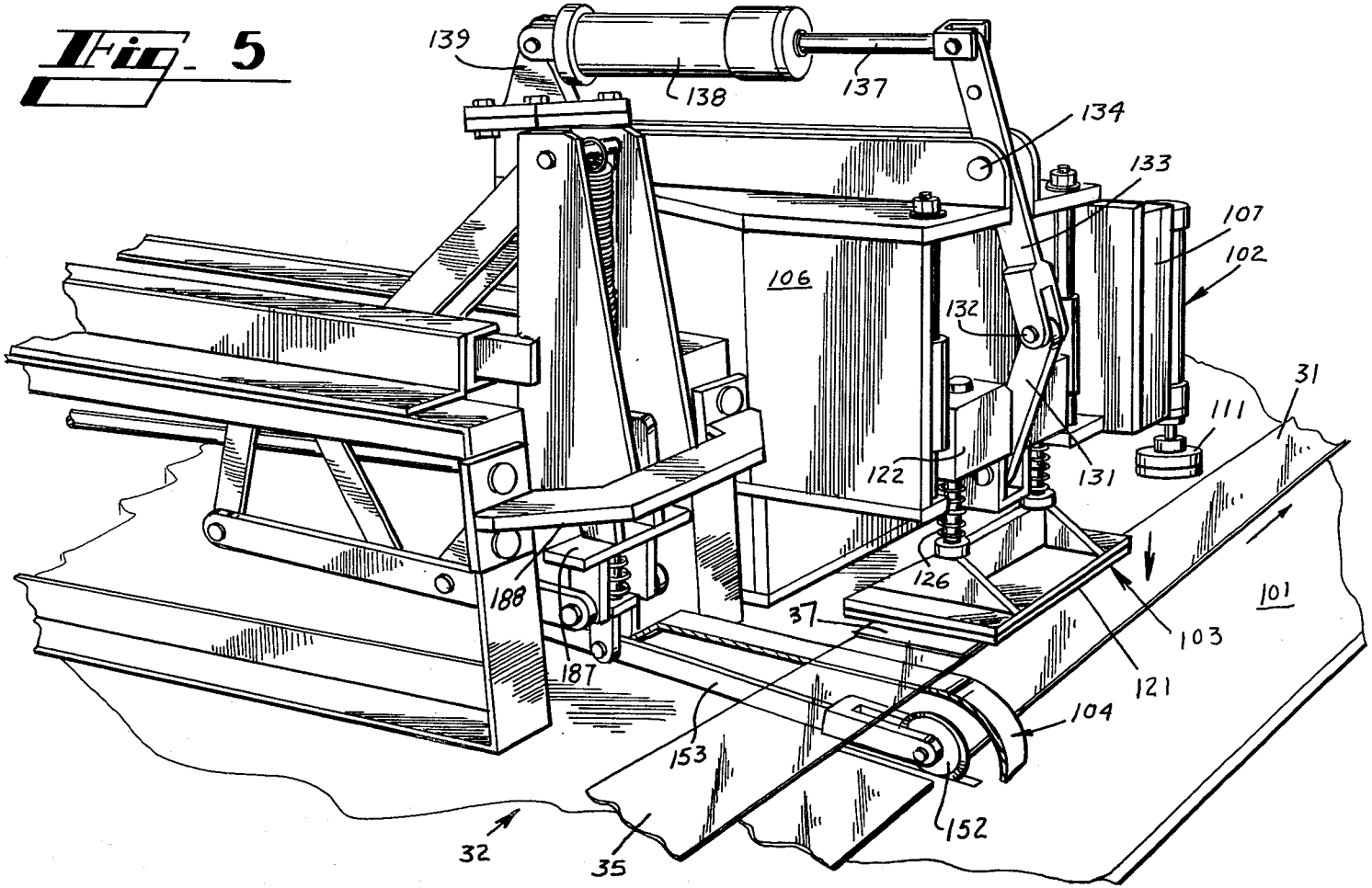
FIG. 5 is a perspective view of a splicing portion of the apparatus of FIG. 1 to show a tape-cutting device and a tape-holding device.
Figure 11:
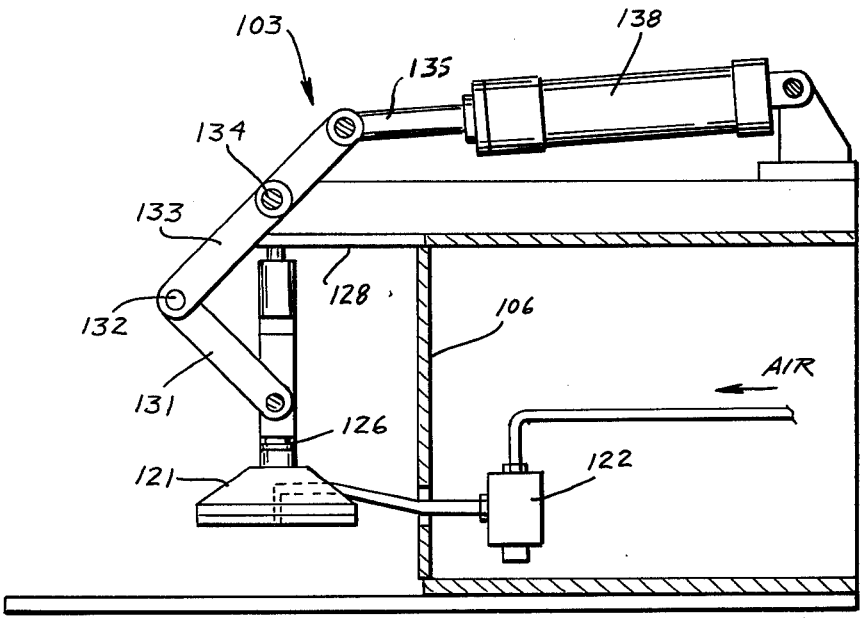

FIG. 11 is a side elevational view of the tape-holding device of FIG. 5.

DETAILED DESCRIPTION

Figure 1:
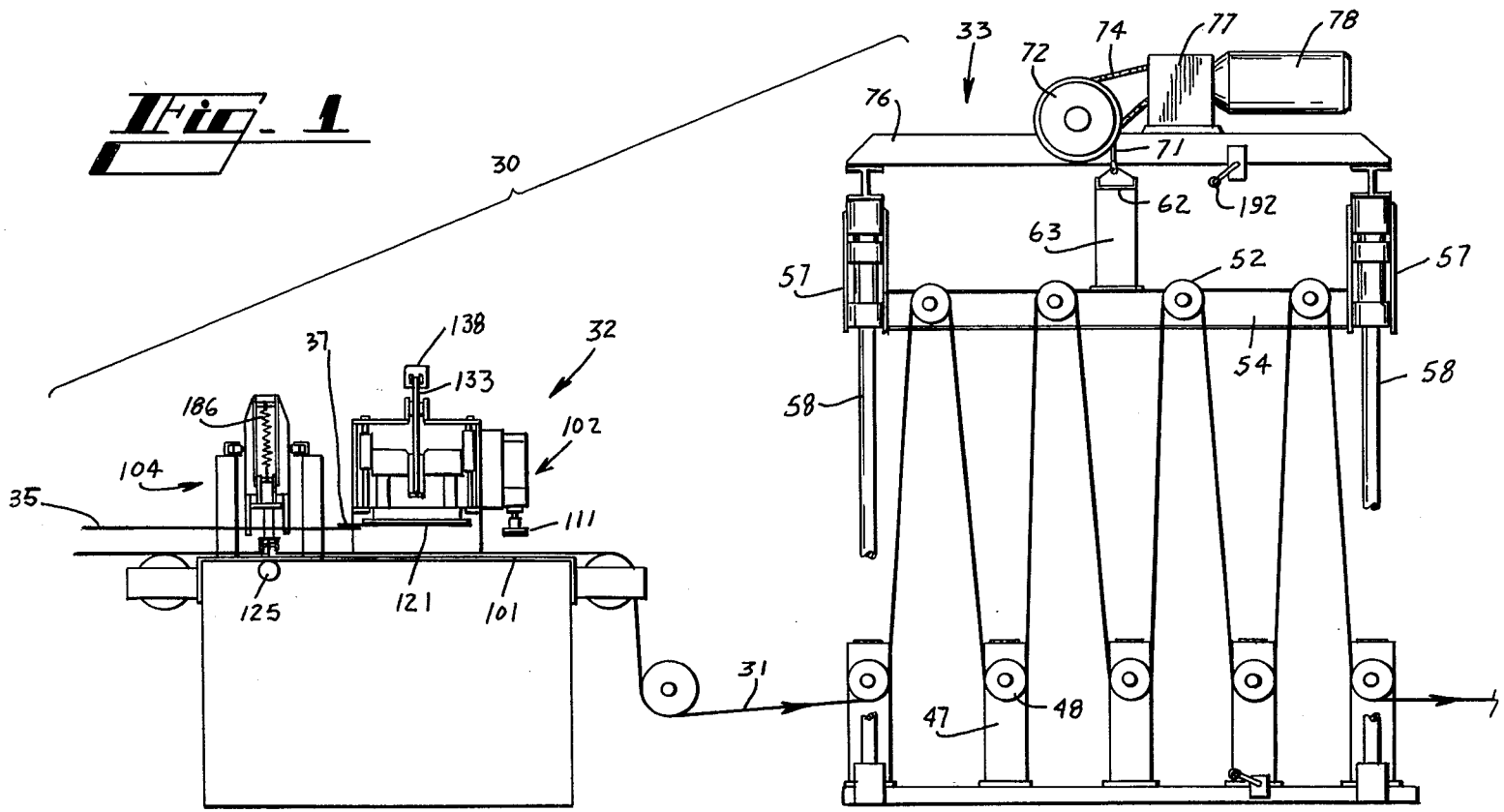
FIG. 1 is an overall elevational view of an apparatus of this invention for accumulating and splicing tapes.

Referring now to FIG. 1, there is shown an apparatus which is designated generally by the numeral 30 for accumulating and for splicing tapes. The tape may be a metallic material, such as aluminum, for example, which is used to form a shield about a cable core or it may be a plastic material which is used to protect the core from the shield. See for example the cable construction shown in U.S. Pat. No. 4,100,003. The tape such as a first tape 31 is advanced from left to right as viewed in FIG. 1 through a splicing apparatus designated generally by the numeral 32 and then through an accumulator designated generally by the numeral 33. The apparatus 30 is designed to cause the first tape 31 to be accumulated in the accumulator 33 after which a portion of the tape adjacent to the input side of the accumulator is clamped. At the time of maximum accumulation, the tape 31 is spliced to a leading end of a tape of a new supply. The tape of the new supply will be referred to as the tape 35. During and subsequent to the splicing, the accumulated tape 31 is payed out from the accumulator 33.

Figure 2:
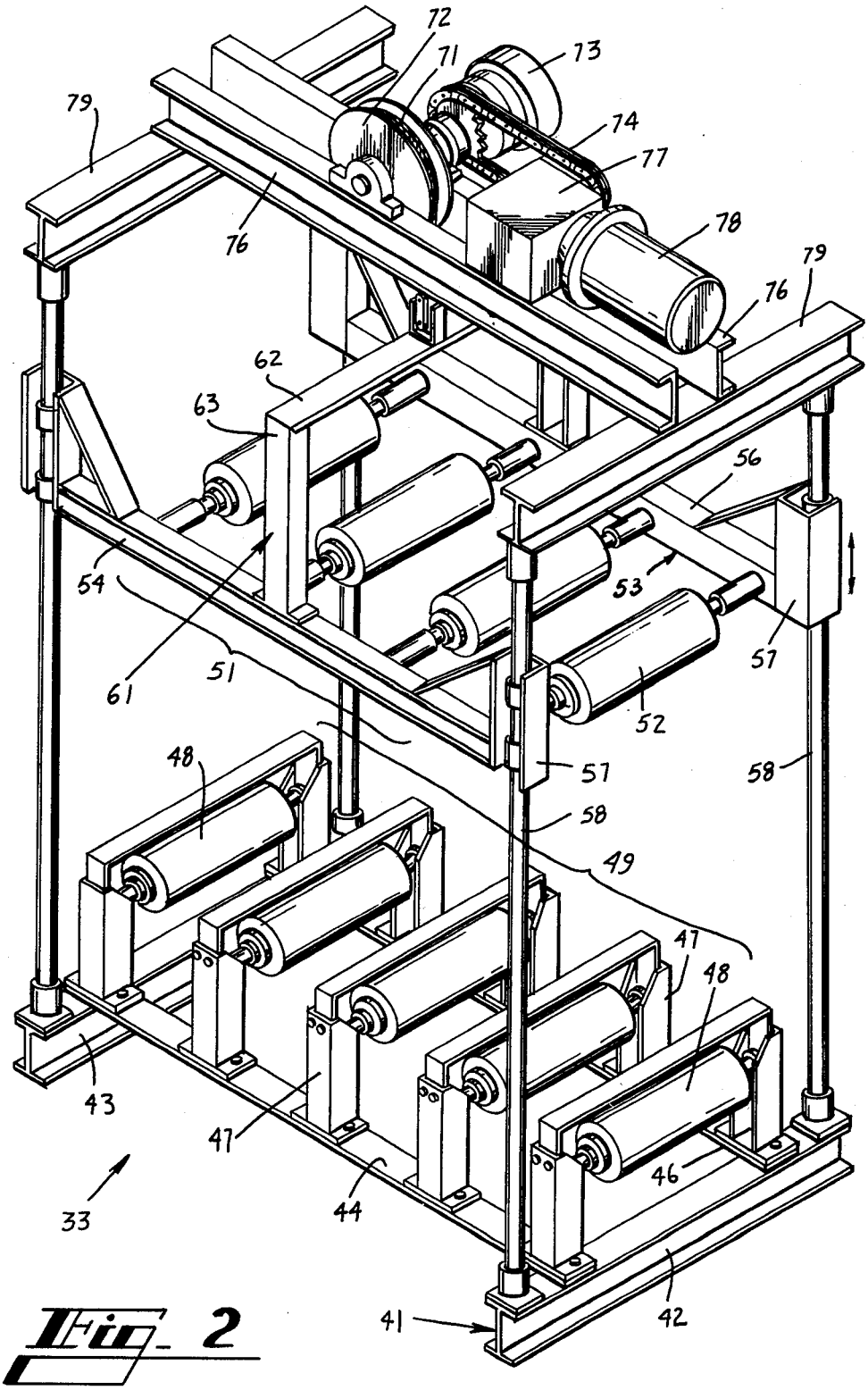
FIG. 2 is a perspective view of an accumulator portion of the apparatus which is shown in FIG. 1.
Figure 3:
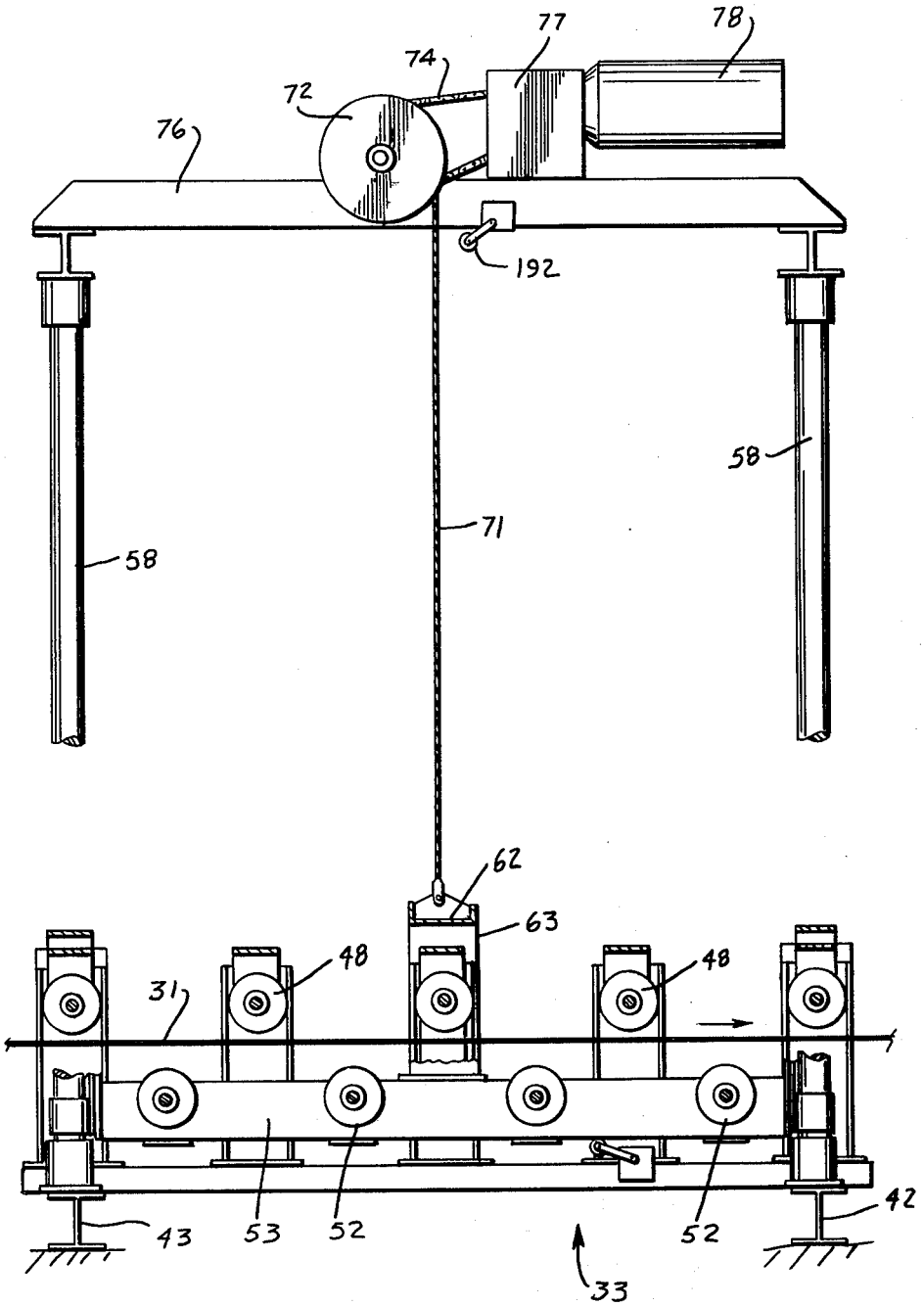
FIG. 3 is a front elevational view of an accumulator of the apparatus of FIG. 2 with a carriage thereof being depicted in a lower position.
Figure 4:
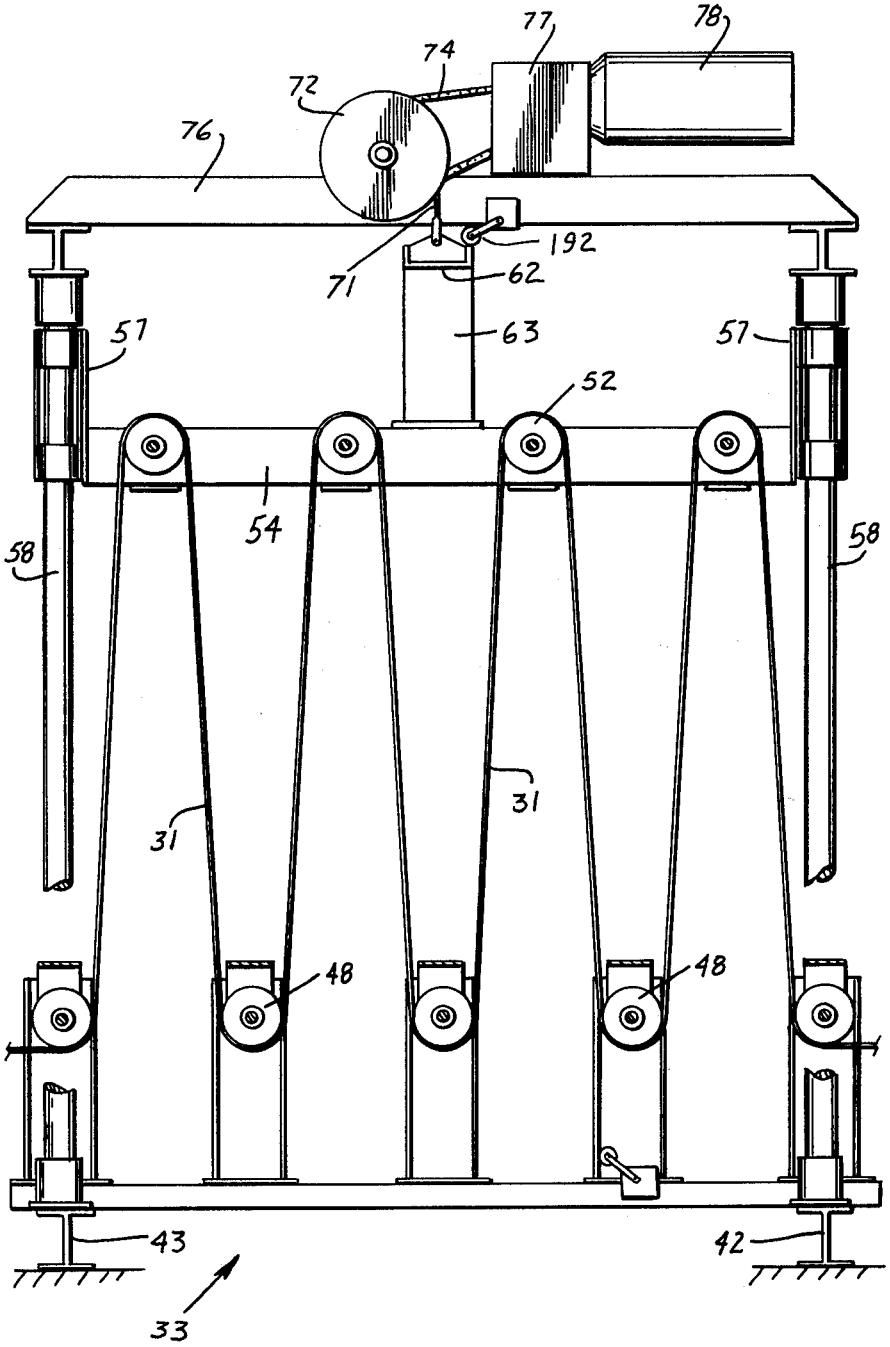
FIG. 4 is a front elevational view of the accumulator with the carriage being in an elevated position.

Going next to FIGS. 2–4, it is seen that the accumulator 33 includes a base 41 which comprises two spaced supports 42 and 43. Two spaced stringers 44 and 46 span between the supports 42 and 43 and have a plurality of pairs of posts 47-47 upstanding therefrom. In each pair of the posts 47-47 is supported rotatably a roller 48 of a first group 49.

The accumulator 33 also includes a second group 51 of rollers 52-52 which are mounted rotatably on a carriage 53 that is movably mounted with respect to the first group 49 of rollers. The carriage 53 is comprised of two beams 54 and 56 which are connected to brackets 57-57 that are slidably mounted on columns 58-58 that are fixedly attached to the supports 42 and 43. The carriage 53 also includes a lifting frame 61 which includes a cross member 62 supported by two stub columns 62-63 that are attached to the beams 54 and 56.

In order to cause the carriage 53 to be moved upwardly or downwardly, the lifting frame 61 has a cable 71 attached thereto. The cable 71 extends upwardly over a sheave 72 which is mounted between two beams 76-76 and which is connected to the shaft of a slip clutch 73. The slip clutch 73 is connected through a chain or belt 74 to a right angle gear box 77 which is connected to a motor 78. As is seen in FIG. 2, the slip clutch 73, the right angle gear box 77 and the motor 78 are mounted on the beams 76-76 which are supported on cross beams 79-79.

The slip clutch 73 is operated by pressurized air which is regulated to control the tension in the tape 31. For example, if because of unexpected line conditions, the tape 31 on the outgoing side of the accumulator 33 experiences a sudden increase in tension, the clutch 73 is caused to slip thereby avoiding undue tension in the tape 31.

In FIG. 3, the apparatus 33 is depicted prior to the accumulation of the tape 31. As is seen, the carriage 53 is in an unoperated, down position with the rollers 48-48 being spaced above the rollers 52-52 of the second group 51. The tape 31 extends through the accumulator 33 between the two groups of rollers.

Going now to FIG. 4, the accumulator 33 is shown in an operated condition with the carriage 53 having been elevated to a position above the first group 49 of the rollers. In being moved to that position, the rollers 52-52 are moved between the rollers 48-48 of the first group. As a result, the tape 31 is carried with the second group of rollers and assumes a sinuous path.

Figure 6:
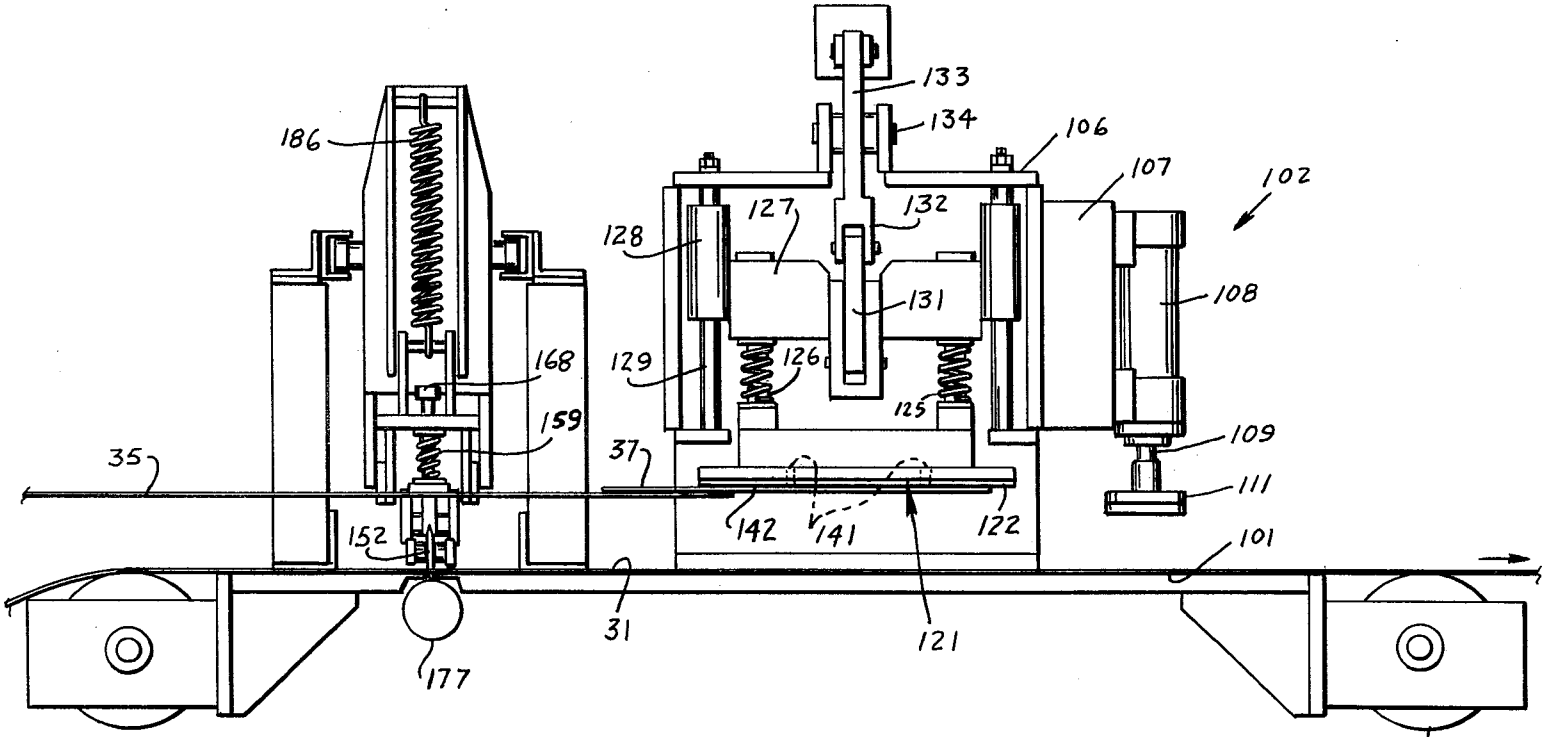
FIG. 6 is a front elevational view of the apparatus of FIG. 5.

Turning now to the splicing portion 32 of the apparatus 30 as shown in FIGS. 5–6, it is seen that the nearly exhausted tape 31 is in engagement with a table 101 as it is being advanced. The splicing apparatus 32 includes facilities for clamping a portion of the tape 31 which is adjacent to the accumulator 33, for connecting a leading end of the tape 35 from a new supply to the tape 31 of the presently used supply and provisions for severing the presently used tape 31 adjacent to the spliced joint.

The provisions for carrying out this sequence of steps includes a clamping device designated generally by the numeral 102, and facilities designated generally by the numeral 103 for joining together end portions of the two tapes 31 and 35. The apparatus 32 also includes facilities 104 for severing the presently used tape 31 after it has been connected to the new tape 35. The splicing apparatus 32 also includes a pair of rollers 105-105 which are mounted rotatably at ends of the surface 101.

Figure 7:
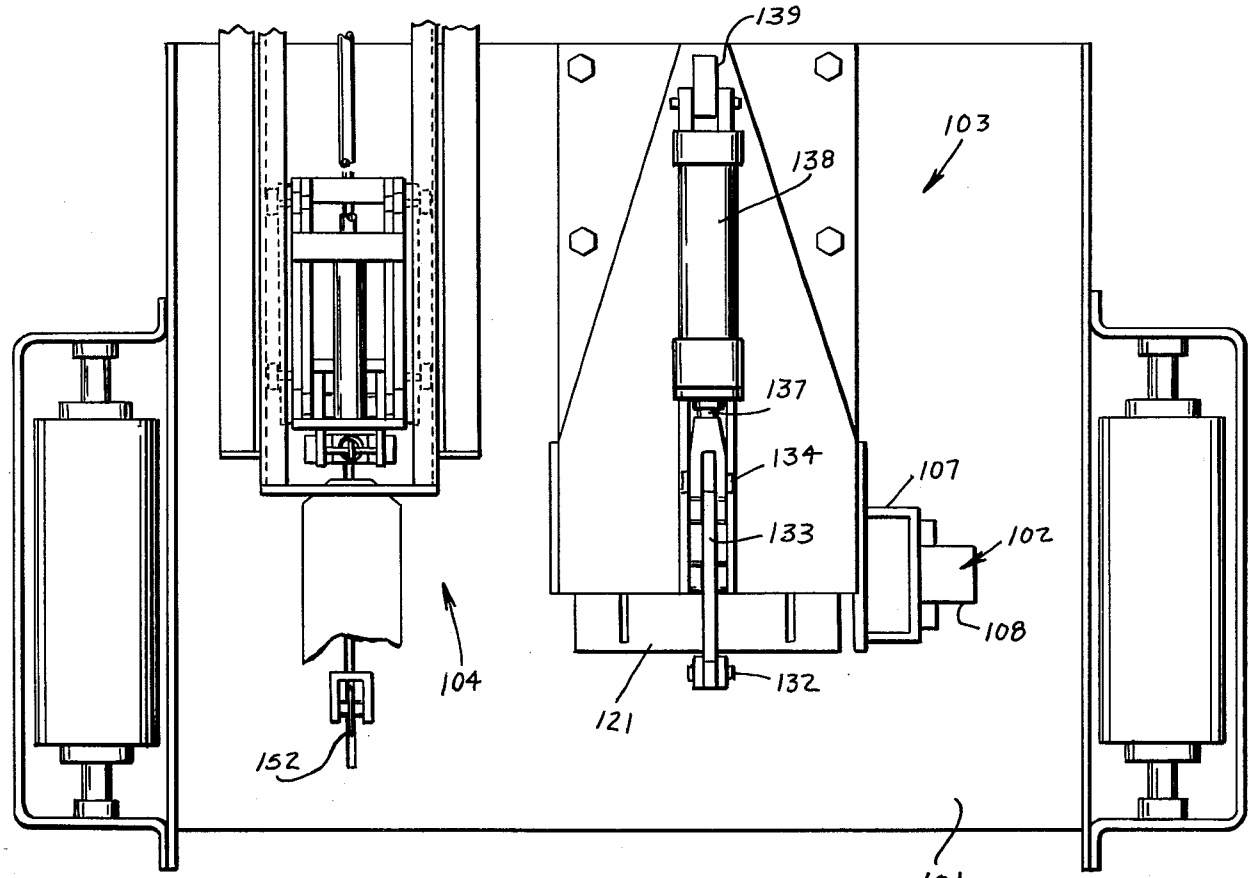
FIG. 7 is a plan view of the apparatus of FIG. 6.

Referring now to FIGS. 6–7, it is seen that the clamping facilities 102 includes a frame 106 having a bracket 107 extending outwardly therefrom. The bracket 107 is used to support a pneumatically controlled cylinder 108 from which a piston rod 109 is extendable. The rod 109 has a pad 111 of a resilient material attached thereto for engaging the tape 31 of a presently used supply to clamp the tape in engagement with the surface 101.

The joining facilities 103 are also supported from the frame 106 and include a supporting element 121 having a pad 122 of resilient material for holding a length 37 of an adhesively-backed tape which is positioned adjacent to and which overlaps a leading end of the tape 35 of the new supply. The supporting element 121 is attached to each end of two rods 126-126 which depend from a saddle 127 that is attached at each end thereof to a sleeve 128 that is slidably mounted on a guide rod 129 supported in the frame 106. Also, the supporting element 121 is biased downwardly by compression springs 125-125 which are disposed concentrically about the rods 126-126. The compression of the springs 125-125 permits overtravel of the saddle 127 after the pad 122 engages the surface 101.

During the time just before splicing, the new tape 35 is held in an up position spaced above the table 101 by vacuum which is applied through the supporting device 121. In that position and as can be seen in FIG. 6, ports 141-141 which open to a surface 142 of the supporting element 121 hold the leading portions of the adhesive tape 37 above the tape 31 which is being advanced along the table 101. Since the tape 37 is attached to the leading edge of the tape 35 of the new supply, the latter is also held above the table 101 prior to splicing.

In order to move the saddle 127 and hence the supporting element 121 downwardly to cause the adhesively-backed tape 37 which is attached to an upwardly facing surface of the leading end of the new tape 35, the saddle is pin-connected to a link 131 (see FIG. 5) that is pinned at a joint 132 to a lever 133 that has a fulcrum 134. The other end of the lever 133 is pinned to a rod 137 that extends from a piston of a cylinder 138 (see also FIG. 7). The opposite end of the cylinder 138 is pinned to a bracket 139 that is attached to the frame 106.

Figure 8:
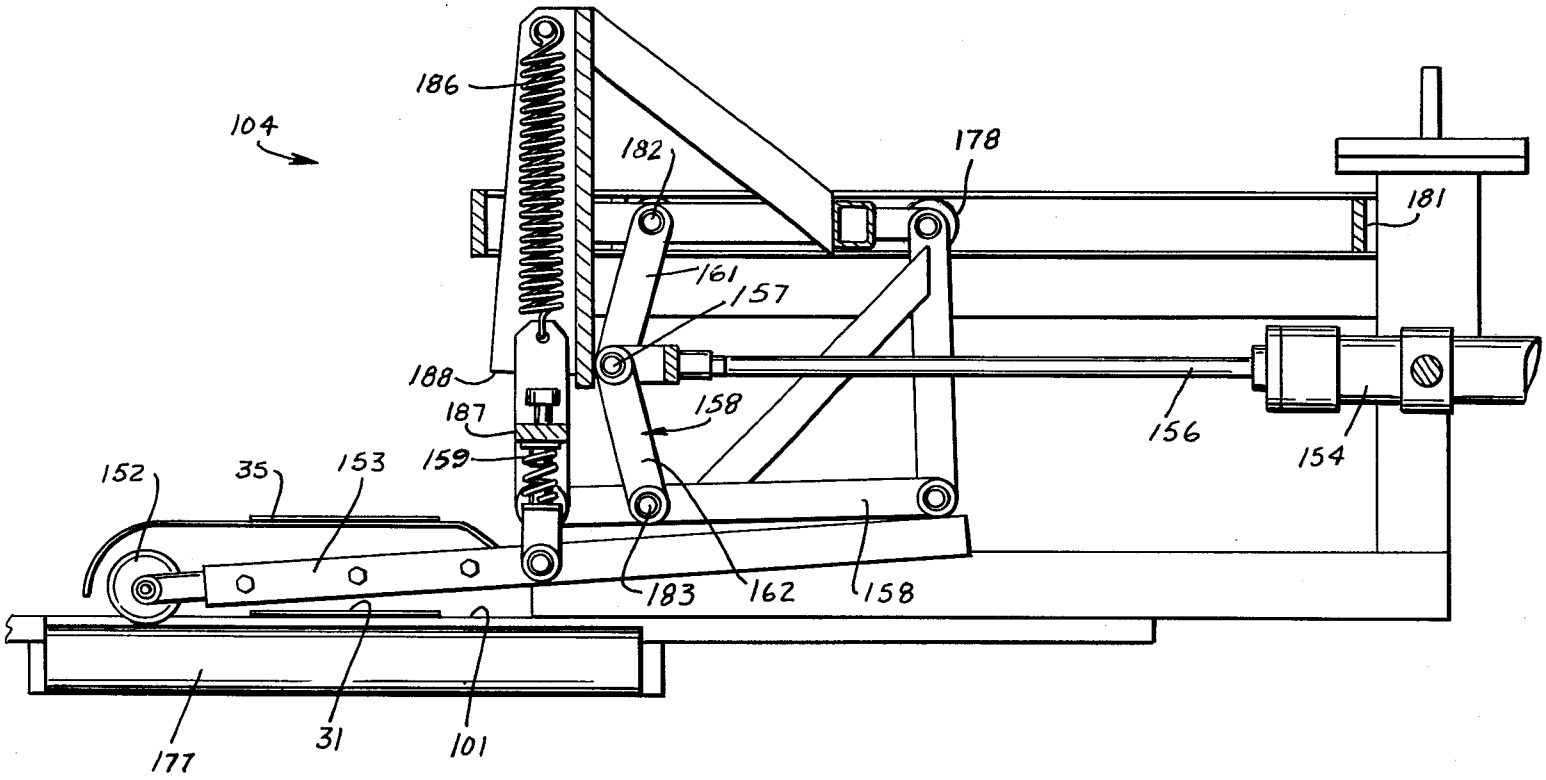
FIG. 8 is a side elevational view of the tape-cutting device shown in FIG. 7.

At the time of cutover to the new tape 35, the cutting device 104 is operated to sever the presently used tape 31. A disc-like blade 152 of the cutting device 104 which is mounted rotatably on an end of a pivotably mounted arm 153 is pulled across the tape 31 to the right as viewed in FIG. 8. This is accomplished by controlling an air cylinder 154 to withdraw a rod 156 to cause a pin connection 157 and links 161 and 162 of a toggle mechanism 158 to be moved to the right. As the pin connection 157 of the links 161 and 162 of the toggle mechanism 158 is moved to the right, a compression spring 159 causes the arm 153 to maintain a downward force applied to the brake 152 to cause it to cut the presently used tape 31 as it is moved thereover.

Figure 9:
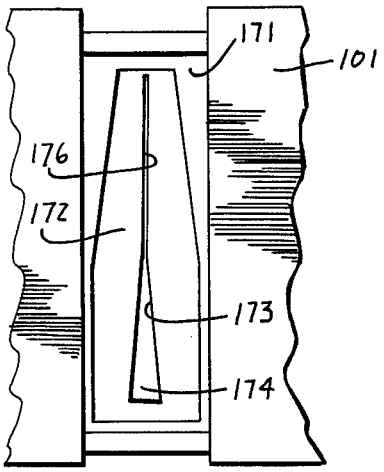
FIG. 9 is an enlarged plan view of a portion of support facilities which cooperate with the cutting device.

As can be seen in FIGS. 5–6 and 9, a special arrangement is used to provide support for the cutting blade 152 as it is moved across the tape 31. The table 101 is formed with an opening 171 for receiving a tapered insert 172 which functions to guide the blade 152 during its cutting stroke and which includes a slot 173. The slot 173 has a wide portion 174 and a narrow portion 176. The opening 171 in the table is sized to allow for both lateral and longitudinal movement of the insert 172. Moreover, because of the configuration of the insert 172, it can turn slightly within the opening 171. Also, a roller 177 (see FIG. 8) is mounted rotatably below the insert 172 with its axis of rotation aligned with the slot 173. Preferably, the roller 177 is made of a relatively hard plastic material.

During the cutting of the tape 31, the blade 152 may not move in a path which is exactly normal to the axis of the tape. The allowance for movement of the insert 172 permits the blade 152 to be moved along with its edge in the slot 173 without the occurrence of any binding. The blade 152 protrudes through the slot 173 and engages the surface of the roller 177 which functions as a back-up. Advantageously, the roller 177 may be turned from time to time to present a fresh portion of its surface as a back-up.

Figure 10A:
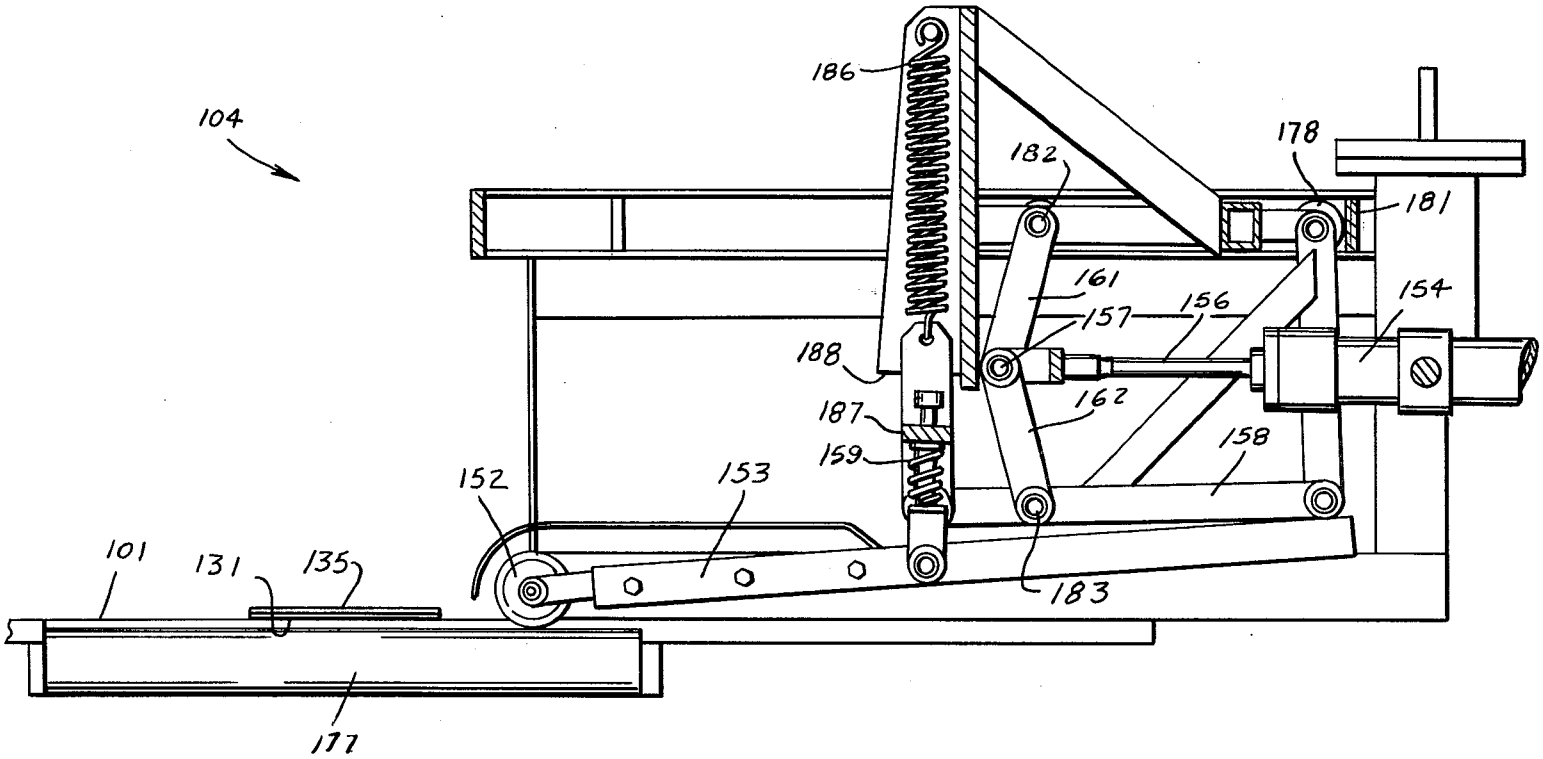
FIGS. 10A and 10B are side elevational views of the tape-cutting device shown in FIG. 8 to depict the device in sequential steps of its operation.
Figure 10B:
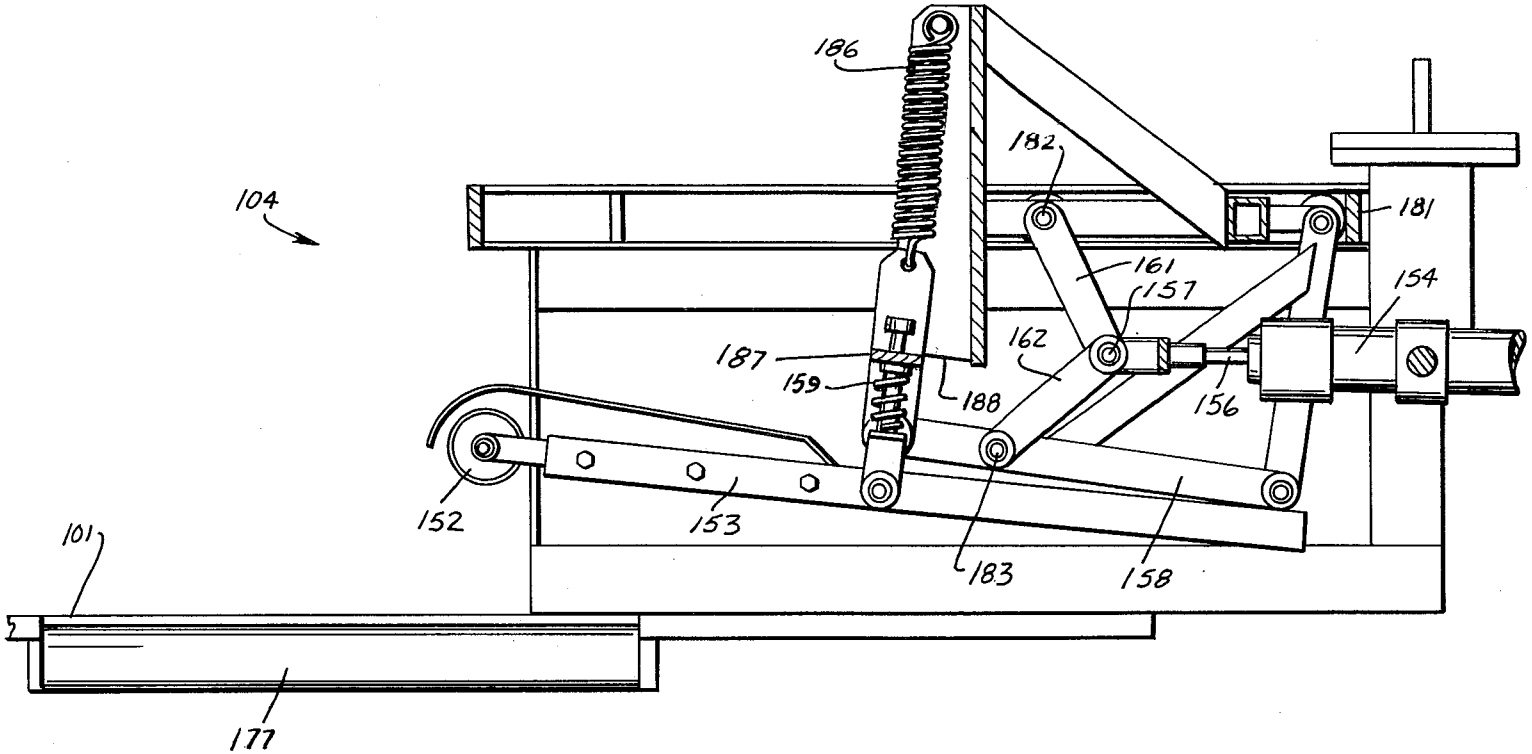

After the toggle mechanism 158 has been moved through a predetermined distance, a wheel 178 of the frame engages a stop 181 (see FIG. 10A), but withdrawal of the rod 156 continues. This causes the pin 157 to overtravel to the right (see FIG. 10B) which moves the links pivotally-161 counterclockwise about a pin 182 and 162 clockwise about a pin 183. This permits forces which have been applied by a tension spring 186 to become effective to move the arm clockwise as viewed in FIG. 10A to the position shown in FIG. 10B until a shelf 187 of the arm engages a stop 188 (see FIG. 5).

It should be observed that the pivotal movement of the links 161 and 162 occurs after the blade 152 has been moved across the tape 31 and past an edge of the new tape 35 which is positioned thereabove. This provides suitable clearance for the blade 152 to be moved upwardly and the arm 153 which had been interposed between new and old tapes to be cleared therefrom.

The operation of the apparatus of this invention is caused to begin either by manual control or when a conventional detector such as a photodetector senses that a supply pad of the tape 31 is about to be exhausted. In response to a signal from the detector (not shown), the accumulator 33 is caused to accumulate a plurality of loops of the tape 31 in a sinusoidal path in preparation for the splicing operation. This is accomplished by controlling the motor 78 to be operated to move the carriage 53 upwardly to move the rollers 52-52 of the second group which had been positioned below the rollers 48-48 of the first group 49 to a position well above the first group (see FIG. 4). As should be apparent, this causes the tape 31 which is being advanced between the two groups of rollers to assume a sinuous configuration having a plurality of storage loops.

As the carriage 53 reaches an uppermost position, it engages a limit switch 192 (see FIGS. 1 and 3) which causes the splicing apparatus 32 to be operated. The engagement of the limit switch 192 by the carriage 53 also causes the rotation of the motor 78 to be reversed and turned at a constant velocity in a reverse direction. At the same time, a portion of the tape 31 adjacent to the input side of the accumulator 33 is clamped to allow a splice to be made with the tape 35.

The cutting device 104 is operated to cause the blade 152 to cut the tape 31 to create a trailing end portion to which the leading end of the new tape 35 is joined. The cylinder 154 is controlled to withdraw the rod 136 and move the pin 157 to the right as viewed in FIG. 8. This causes the blade 152 to be moved across the tape 31 with sufficient pressure applied to cut it. After the blade 152 has cleared the tape 31, the pin 157 has overtraveled the pins 182 and 183 to allow the spring 186 to raise pivotally the arm 153 (see FIG. 10B).

Then the air cylinder 138 of the joining device 103 is controlled to extend its piston rod 137 to turn a link 133 counterclockwise about a pin 134, as viewed in FIG. 11, to cause a link 131 to move the supporting element 121 downwardly. This causes the leading end of the new tape 35 which has the length of adhesively-backed tape 37 adhered thereto to be moved downwardly. At that time, the cut trailing end of the nearly exhausted tape 31 is positioned under the joining device 103 so that the cut end is aligned with the leading end of the new tape 35. The joining device 103 engages the adhesively-backed tape 37 to the trailing end of the tape 31 which effectively splices the present tape to the new tape 35.

At the conclusion of the operation of the cylinder 138 in this cycle, its rod 135 is fully extended to the left as viewed in FIG. 11. This causes the pin 132 to be moved to the right of the supporting element 121. As a result, the tape-supporting element 121 is moved upwardly from the surface 101 to the position shown in FIG. 11 in preparation for another cycle of operation. In the next cycle of operation, the cylinder 138 is controlled to withdraw the rod 135. This arrangement for the movement of the tape-supporting element 121 contributes to the relatively short duration, i.e., about one to two seconds, of the splicing operation since the cylinder 138 effects a cycle of operation during each direction of movement of its rod.

The splicing operation which is accomplished within a time period of one to two seconds occurs just as the carriage 53 begins its downward movement. During the splicing operation, the carriage 53 is moved downwardly at a substantially constant velocity which is less than the velocity at which the tape 31 is being advanced out of the accumulator 33.

The motor 78 which has been controlled to be operated in a reverse direction allows the carriage 53 to descend under its own weight and under the tension being applied to the tape 31. The slip clutch 73 is used to provide an upwardly directed force in the cable to cause the tape 31 to be under tension. It should be readily apparent that a cylinder arrangement with proper pressure control could be used instead of the slip clutch in order to provide suitable back tension.

In the prior art, the group of rollers which has been elevated to facilitate the accumulation of tape is held at the elevated position by a counterweight, for example. That group of rollers is moved downwardly by the tape which is still being advanced outwardly. During this stage, the counterweight provides for back tension on the tape. The release of the trailing end of the tape after a splicing operation, for example, results in a sudden "jerking" of the tape material against the action of the counterweight.

This undesirable pull which is imparted to the strip material is avoided by the accumulator 33. The accumulator 33 includes means such as a pneumatically controlled piston and cylinder arrangement or the slip clutch 73, for example, which results in a positive downward velocity to the platform on which the first group 48 of rollers is mounted. After the splice has been made, the voltage which is applied to the motor control circuit is decreased in a controlled manner to cause the velocity of the motor 78 to decrease linearly. This causes the velocity, $V_o$, of the carriage 53 to be decreased linearly as it is moved downwardly and as the velocity, $V_1$, of the new tape 35 increases from zero and reaches line speed, $V_L$. Since $V_o$ is less than the line speed $V_L$, and since $V_o$ decreases as the carriage 53 moves downwardly, the velocity of the spliced tape at the input side to the accumulator 53 accelerates and does so at a gradual rate. As a result, the tape 35 on the input side of the accumulator 33 experiences a controlled, substantially constant acceleration as opposed to the uncontrollable acceleration of tapes in prior art accumulators.

The control of the motor 78 may be accomplished in any of a number of well-known arrangements. For example, an adjustable resistor which is included as part of the control circuit may be connected to the cable 71 so that as the carriage 53 descends under the urging of the tape 31, the resistor value changes to cause the applied voltage to decrease in a linear manner.

Then the air cylinder 154 is controlled to move the pin connection 157 to the left to move the blade 152 across but spaced above the path of the new tape 35 which is now in engagement with the table 101. Further movement of the pin 157 causes the arm 153 to be moved pivotably counterclockwise to engage the blade 152 with the plastic roller 177 (see FIG. 8) in preparation for another cutting stroke after the new strip supply has been exhausted.

The arrangement of the insert 172 within the opening 171 is particularly advantageous during the return of the blade 152 to its starting position for another cycle of operation. Although the path of movement of the blade 152 or other parameters may be somewhat less than exactly defined, the excess width of the one portion 174 of the slot 173 insures that the peripheral edge of the blade is received within the slot in preparation for another cycle of operation.

As can be imagined, the mounting arrangement for another path of movement of the cutting blade 152 decreases the time required for splicing. Since the return of the cutting blade to its start position is accomplished in a path above the spliced tapes, the tapes may be advanced while the return is being made. The time for splicing need not include the blade return time and contributes to the relatively short time, i.e., one to two seconds, required for this operation.

The severing facilities 104 and the joining facilities 103 which have been described are best suited for severing and for joining tapes of a relatively soft metal such as aluminum or of plastic. It should be apparent that other facilities which fall within the scope of this invention could be used to sever and to join steel tapes. For example, the leading and trailing ends of steel tapes could be joined by welding.

It is to be understood that the above-described arrangements are simply illustrative of the invention. Other arrangements may be devised by those skilled in the art which will embody the principles of the invention and fall within the spirit and scope thereof.

What we claim is:

1. Apparatus for splicing tapes, said apparatus including:

advancing means for moving a first tape along a path of travel;

holding means for supporting an adhesively-backed tape, that is joined to a leading end portion of a second tape and that is to be connected to a trailing end portion of the first tape, spaced from the path of travel;

surface means being positioned along the path of travel for supporting the first tape;

first mounting means for mounting said holding means for movement between said surface means and a position spaced therefrom;

severing means for cutting the first tape to form a trailing end portion;

second mounting means for mounting said severing means for movement transversely across the first tape, said second mounting means including:

means for normally biasing said severing means in engagement with a portion of said surface means; and means for spacing said severing means from said surface means;

moving means for causing said second mounting means to be moved transversely across the first tape to cause said severing means to cut said first tape and form a trailing end;

means rendered effective by the movement of said severing means across the first tape for causing said biasing means to release said severing means and allow said spacing means to become effective to space said severing means from said surface means; and means responsive to said severing means being spaced from said surface means for moving the leading end portion of the second tape to engage the adhesively-backed tape with the trailing end portion of the first tape to connect the second tape to the first tape.

2. The apparatus of claim 1, wherein said surface means includes an opening, an insert which is received in said opening and which includes a slot, and a roller which is mounted rotatably below and aligned with said slot of said insert.

3. The apparatus of claim 2, wherein subsequent to said moving means causing said severing means to cut the first tape and subsequent to said severing means being spaced from said surface means, said moving means is effective to cause said severing means to be returned transversely across the first tape which is joined to the second tape by the adhesively-backed tape.

4. The apparatus of claim 3, wherein said severing means includes a disc-like blade and wherein said moving means is controlled to be effective to cause said severing means to be moved to position said blade thereof in said slot and to engage said roller for another cycle of operation.

5. The apparatus of claim 4, wherein said slot has an enlarged portion at one end thereof to insure receipt of said blade.

6. The apparatus of claim 1, wherein the first tape is advanced along its path of travel at a line speed, and wherein said apparatus also includes accumulating means for storing a length of the first tape to permit the splicing of the second tape to the first tape while the first tape continues to be advanced at the line speed and at a constant tension, and to cause the second tape to be accelerated to the line speed at a uniform rate.

7. The apparatus of claim 5, wherein said accumulating means includes:

a first group of rollers which are spaced apart and which are mounted rotatably;

a second group of rollers which are mounted rotatably and which alternate with said rollers of said group;

means for mounting said second group of rollers for movement between one position where the rollers of the second group are spaced below said rollers of said first group and another position where they are spaced above said rollers of said first group;

said advancing means being effective to move a first tape at a substantially constant line speed into an entry of an undisturbed path between said rollers of said first group and said rollers of said second group;

means responsive to a signal indication of a need to store a length of the first tape for moving said second group of rollers from the one position below said first group to the other position spaced above said first group to lengthen the path of the tape between rollers of each group and to cause a length of the first tape to be stored in a sinuous configuration;

clamping means rendered effective prior to the splicing of a leading end of the second tape to a trailing end portion of the length of the first tape for preventing further movement of the first tape into an entry of the path, the first tape continuing to be advanced out of the exit of the path at the line speed;

means for allowing said advancing means to withdraw the length of the first tape which is stored in the sinuous configuration from the exit of the path and substantially at the line speed to provide a continuous supply of the first tape, the withdrawal of the stored length of the first tape being effective to cause said second group of rollers to return toward said position below said first group; and controlling means for causing the return of said second group of rollers to be continuous toward said first group to said position adjacent to said first group, and to be at a velocity which initially is substantially constant while the second tape is being spliced to the first tape, and then at a velocity which decreases linearly at a controlled rate and which is less than the line speed, said controlling means being effective to cause the second tape being advanced into the path to be tensioned and to be accelerated gradually at a substantially linear rate to the line speed and in a manner such that the velocity of the second tape does not exceed the line speed.

* * * * *